US012611074B2

(12) United States Patent
Goletzke et al.

(10) Patent No.: US 12,611,074 B2
(45) Date of Patent: Apr. 28, 2026

(54) SEPARATING TOILET

(71) Applicant: Duschkraft GmbH, Rostock (DE)

(72) Inventors: Stefan Goletzke, Papendorf (DE); Arvid Sylvester Reinwaldt, Rostock (DE); David Bredt, Rostock (DE)

(73) Assignee: Duschkraft GmbH, Rostock (DE)

( * ) Notice: Subject to any disclaimer, the term of this patent is extended or adjusted under 35 U.S.C. 154(b) by 720 days.

(21) Appl. No.: 18/063,857

(22) Filed: Dec. 9, 2022

(65) Prior Publication Data

US 2023/0397780 A1 Dec. 14, 2023

(30) Foreign Application Priority Data

Jun. 9, 2022 (DE) ..... 202022103251.3

(51) Int. Cl.
*A47K 11/02* (2006.01)
*A47K 11/12* (2006.01)

(52) U.S. Cl.
CPC ..... *A47K 11/02* (2013.01); *A47K 11/12* (2013.01)

(58) Field of Classification Search
CPC ..... A47K 11/00–08; A47K 13/00–105; A47K 13/06–08; A47K 13/12; A47K 13/26; A61B 10/0038; B65D 1/26; B65D 43/18; B65F 1/1607; B65F 1/1646; E03D 5/014
See application file for complete search history.

(56) References Cited

U.S. PATENT DOCUMENTS

| | | | | | |
|---|---|---|---|---|---|
| 3,118,146 | A * | 1/1964 | Dorey | A47K 11/02 | 4/476 |
| 3,601,822 | A * | 8/1971 | Weiss | A47K 13/06 | D23/311 |
| 4,893,719 | A * | 1/1990 | Lombardi | B65F 1/006 | 220/909 |
| 5,170,516 | A * | 12/1992 | Davison | A47K 11/06 | 4/479 |
| 6,889,604 | B2 * | 5/2005 | Ernst | B65F 1/1405 | 100/246 |
| 8,276,219 | B2 * | 10/2012 | Dubiel | A47K 11/06 | 4/479 |
| 10,568,472 | B1 * | 2/2020 | Ashur | A47K 11/02 | |
| 2006/0070995 | A1 * | 4/2006 | Huang | B65F 1/1607 | 220/254.5 |
| 2009/0000020 | A1 * | 1/2009 | Ziborov | A47K 11/02 | 4/479 |
| 2022/0047128 | A1 * | 2/2022 | Van Varick | A47K 11/04 | |

FOREIGN PATENT DOCUMENTS

| | | | | |
|---|---|---|---|---|
| DE | 202019005509 U1 | | 10/2020 | |
| DE | 202020105678 | * | 10/2020 | A47K 13/26 |
| DE | 202020105678 U1 | | 10/2020 | |
| DE | 102019128862 A1 | | 4/2021 | |
| JP | 2007054524 | * | 3/2007 | A47K 11/04 |
| KR | 20170124317 | * | 11/2017 | A47K 11/026 |

* cited by examiner

*Primary Examiner* — David P Angwin
*Assistant Examiner* — Nicholas A Ros

(57) ABSTRACT

A separating toilet having a separating insert and at least one first collecting unit for urine and a second collecting unit for feces, wherein the separating insert as a whole is inserted into an opening of a transport container and is supported in the vertical direction on projections that protrude from an inner side of the transport container toward an interior of the transport container.

17 Claims, 5 Drawing Sheets

SEPARATING TOILET

FIELD OF THE INVENTION

The invention relates to a separating toilet.

DESCRIPTION OF THE PRIOR ART

A separating toilet of this kind is known, for example, from DE 20 2020 105 678 U1. A separating toilet of this kind is relatively complex to manufacture and assemble since it has a large number of individual parts and also has a structurally complex container design for accommodating the separating toilet.

DE 10 2019 128 862 A1 has disclosed a separating toilet system, which has odor-minimization means. For example, proposals include check valves for urine. This separating toilet system also comprises a large number of individual parts and is relatively complex to manufacture.

The object of the invention, therefore, is to disclose a separating toilet, which in comparison to the prior art has a high strength while having a reduced number of components and is also easy to install. In a particular embodiment, the separating toilet according to the invention should be easily stackable with other objects. Overall, the separating toilet should be inexpensive and easy to manufacture. Another object of the invention is to embody the separating toilet in such a way that it is easy to disassemble, especially in order to thus ensure good accessibility to all of the individual parts, for example for cleaning purposes.

SUMMARY OF THE INVENTION

The invention relates to a separating toilet having a separating insert and at least one first collecting unit for urine and a second collecting unit for feces, wherein the separating insert as a whole is inserted into an opening of a transport container and is supported in the vertical direction V on projections that protrude from an inner wall of the transport container toward the interior of the transport container.

When the separating insert is inserted into an opening of the transport container, an upper edge of the side walls of the transport container remains free, according to the invention, in order to optionally keep these upper edges free for accommodating covers of the transport container and/or for other stacking containers, in particular structurally identical ones, which can be stacked on the transport container.

In a preferred embodiment, a circumferential peripheral edge of the separating insert has recesses with which the separating insert can be placed onto the projections.

On the one hand, the circumferential peripheral edge of the separating insert ensures an enhanced stability of the separating insert against warping or flexing, particularly of a seat of the separating insert. On the other hand, the recesses in these circumferential peripheral edges can make the separating insert self-supporting and stable and allow it to be placed directly onto the corresponding projections. This eliminates the need for additional reinforcing components such as supporting plates or the like, of the kind that can be provided in the prior art. It is thus possible to achieve a particularly stable and simple design that requires only a few components.

In another preferred embodiment, a seat of the separating insert ends flush with an upper edge of the transport container.

This makes it possible to close the transport container at the top and to cover the separating insert merely by providing a flat cover, which can be produced very easily, particularly in a single piece. In addition, free upper edges of the transport container are not covered by the separating insert so that the free upper edges of the transport container are available for receiving and supporting a cover or for receiving protruding components of a container that is to be stacked on top.

It can also be advantageous to embody a circumferential peripheral wall of the separating insert as at least partially stepped in cross-section, for example with a shoulder, so that between the separating insert and an upper region of the separating container inner wall, a circumferential insertion gap is formed when the separating insert is inserted into the transport container.

The circumferential gap can be useful on the one hand for receiving a reinforcing rib for a flat cover and on the other hand for providing the necessary geometrical clearance in order to embody the separating insert so that it can be opened in hinged fashion relative to the transport container.

It can also be advantageous for the gap to be oriented and embodied in such a way that the rib region, in particular circumferential ribs of a cover, can be guided into the insertion gap.

The insertion gap can thus serve to ensure a secure closing of the transport container by at least partially receiving circumferential ribs of the cover. With a suitable embodiment of the insertion gap or more precisely, of the insertion gap width, it is even possible to optionally provide a clamping retainer for the cover.

It can be particularly advantageous for the separating insert to be supported so that it moves in hinged fashion around at least two projections, in particular in a pivotable fashion relative to the transport container.

This especially facilitates access to the two collecting units under the separating insert, which has advantages particularly during cleaning of the separating toilet. It is also possible, however, to embody the separating insert so that it can be secured in an open position so as to allow the collecting units to be manipulated with both hands, without needing one hand to hold the separating insert.

The ease-of-maintenance is further promoted if the separating insert has a recessed grip, in particular a recessed grip positioned at the edge.

The separating toilet according to the invention can be produced in a particularly inexpensive way if the transport container is a stackable container, in particular a euronorm container.

In this embodiment, in a particularly space-saving way, the separating toilet according to the invention can be part of a container stack that is carried along, for example as a container stack, in a vehicle such as a camping vehicle.

The transport container is advantageously embodied as a metal, wood, or plastic container.

It has turned out to be particularly advantageous for the separating insert to be deep drawn from a thermosetting plastic, in particular an ABS plastic plate material. On the one hand, this can be produced in an inexpensive, lightweight fashion, particularly with a low degree of complexity with regard to the deep-drawing form.

In a particularly simple way, especially in the region of side walls of a euronorm container, the projections can each be formed by a respective cap nut, which is screwed onto a screw that reaches through the side wall of the transport container.

A standardized euronorm container can thus be converted in a particularly simple way into a suitable transport container for the separating toilet according to the invention.

Viewed from above, an outer contour of the separating insert is advantageously adapted to an inner contour of the transport container and can be inserted without play or almost without play into the opening of the transport container. In particular, this can be done in such a way that free upper edges of the side walls of the transport container remain free. In order to ensure an operation that is as rattle-free as possible, it is advisable to carry out an adaptation that is without play or almost without play. In this connection, "almost without play" should be understood, for example, to mean with a circumferential gap width in a range from a few tenths of a millimeter up to at most 1 mm. If the gap width is selected to be larger, then the separating toilet according to the invention is indeed basically functional, but unwanted potential movements between the separating insert and the transport container must be expected.

BRIEF DESCRIPTION OF THE DRAWINGS

The invention will be explained in greater detail by way of example based on the drawings. In the drawings.

DETAILED DESCRIPTION OF THE PREFERRED EMBODIMENTS

Figure 1:
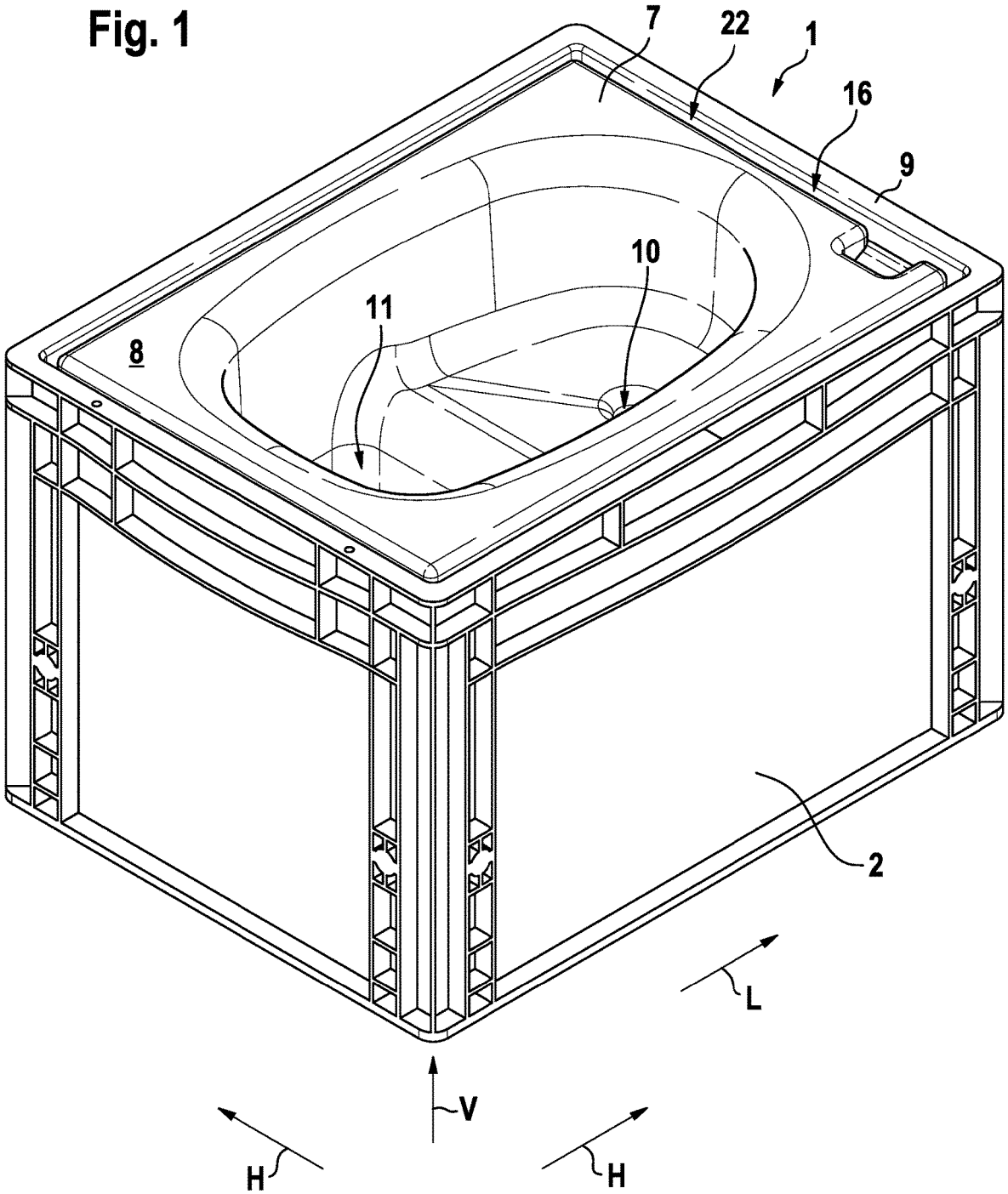
FIG. 1: shows a perspective view of a separating toilet according to the invention.
Figure 2:
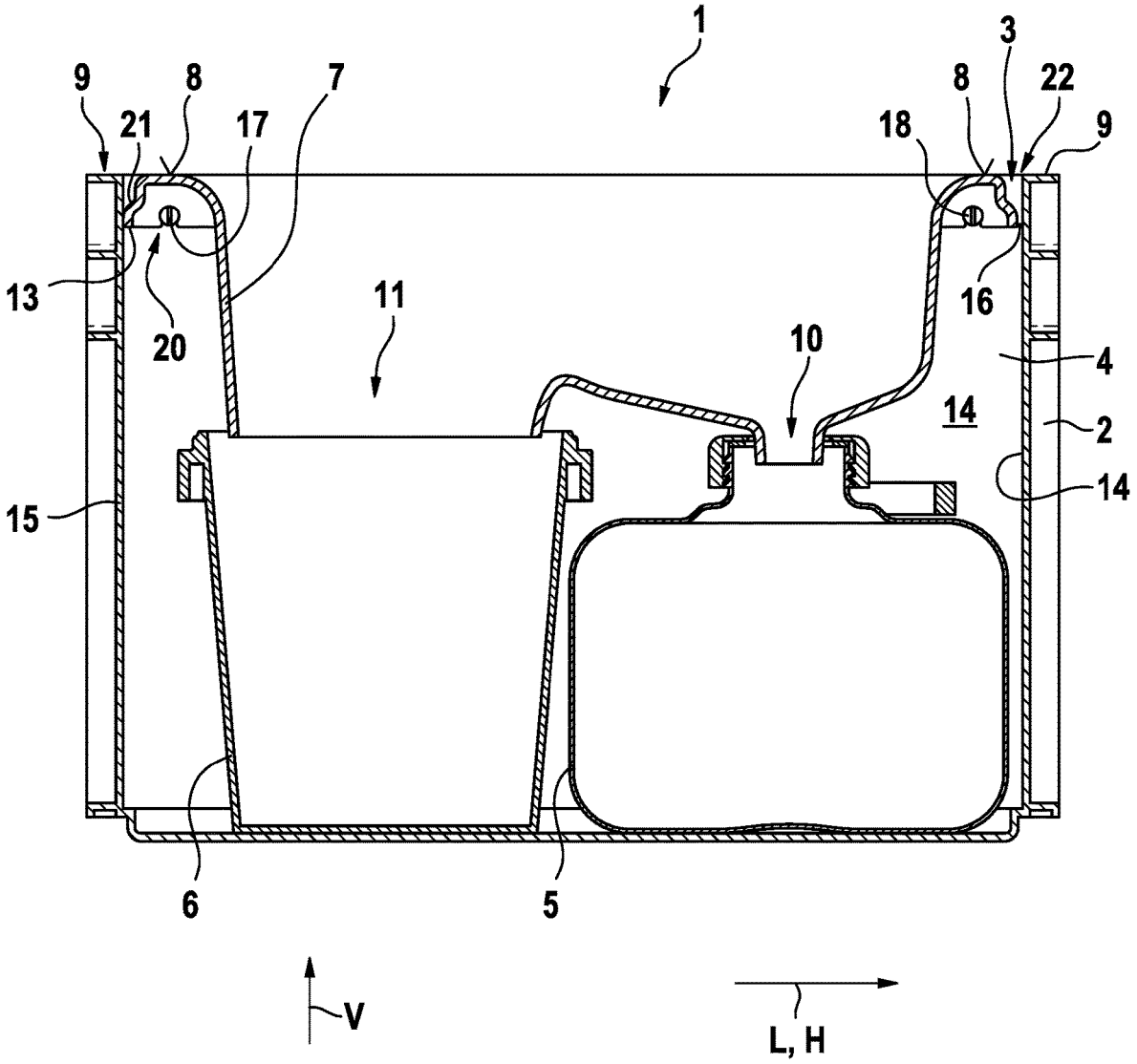
FIG. 2: shows a longitudinal section through the separating toilet according to the invention from FIG. 1.

The basic design of a separating toilet 1 according to the invention will be explained below based on FIGS. 1 and 2. In this connection, FIG. 1 shows an isometric view of a separating toilet 1 according to the invention and FIG. 2 shows a longitudinal section along a central plane of the separating toilet 1.

The separating toilet 1 has a transport container 2, which is open at the top in a vertical direction V and has an opening 3. The transport container 2 encloses an interior 4. A first collecting unit 5 and a second collecting unit 6 are positioned in the interior 4 of the transport container 2. For example, the first collecting unit 5 is embodied as a canister and is used for holding urine. For example, the second collecting unit 6 is embodied as a box or bucket that is open at the top and is used for holding feces.

The first collecting unit 5 and the second collecting unit 6 are positioned next to each other in a longitudinal direction L of the transport container 2 in the interior 4 of the transport container 2.

A separating insert 7 is inserted into the opening 3 in such a way that a seat 8 preferably ends flush with a free upper edge 9 in the vertical direction V.

The separating insert 7 has a first outlet 10 for urine and the first outlet 10 feeds into the first collecting unit 5. The separating insert 7 also has a second outlet 11, which feeds into the second collecting unit 6. The separating insert 7 also has a circumferential peripheral edge 13, which when the separating insert 7 is inserted into the transport container 2 points downward in the vertical direction V toward a bottom of the transport container 2. A small gap 16 is optionally formed between the circumferential peripheral edge 13 and an inner side 14 of side walls 15 of the transport container 2. A gap width of the gap 16 is either 0 mm, which means an insertion of the separating insert 7 without play in the transport container 2, or has a dimension in a range from a few tenths of a millimeter up to preferably at most 1 mm.

Figure 5:
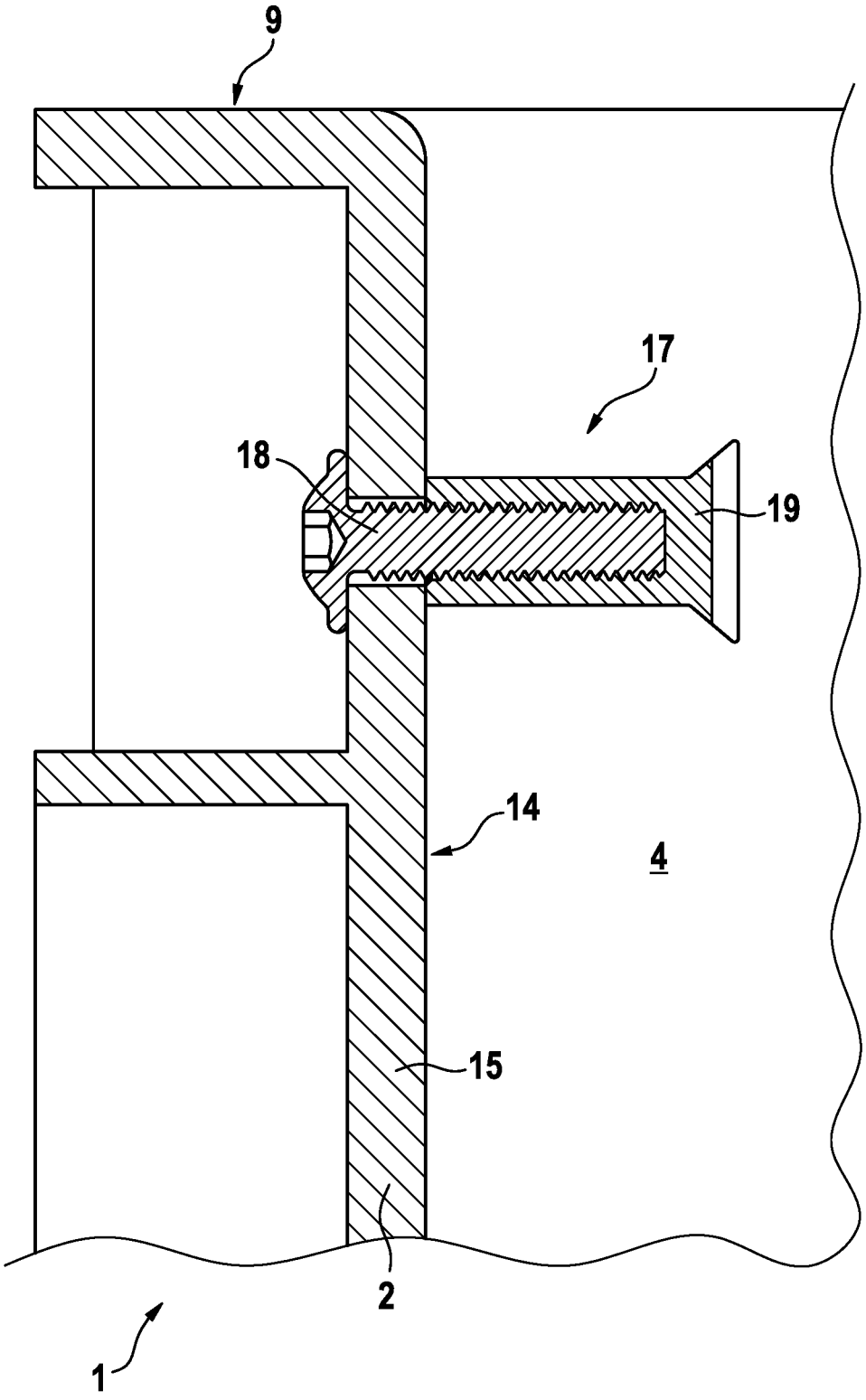
FIG. 5: shows a cross-section through a side wall of the transport container in the region of a projection protruding inward.

On at least two inner sides 14 of side walls 15, there are projections 17, which protrude a short distance into the interior 4 of the transport container 2. In the depiction in FIG. 2, the projections 17 that are visible therein are embodied as screws 18, which reach through a hole in the side wall 15 of the transport container 2 and are secured relative to the transport container 2 by means of a cap nut 19 (also see FIG. 5).

In the region of the peripheral edges 13 corresponding to the projections 17, the peripheral edge 13 of the separating insert 7 has recesses 20, which in the inserted state of the separating insert 7, encompass the projections 17 and rest on them. By means of the projections 17, which engage in the recesses 20, the entire separating insert 7 is supported in the vertical direction V. Since the recesses 20 in the exemplary embodiment are slot-shaped recesses, which are open toward the bottom, these recesses also contribute to horizontally guiding the separating insert 7 relative to the transport container 2. The latter is not absolutely required, though, since the peripheral edges 13 that can be supported on the inner side 14 of the transport container 2 can also perform a guiding function in the horizontal direction H.

Figure 3:
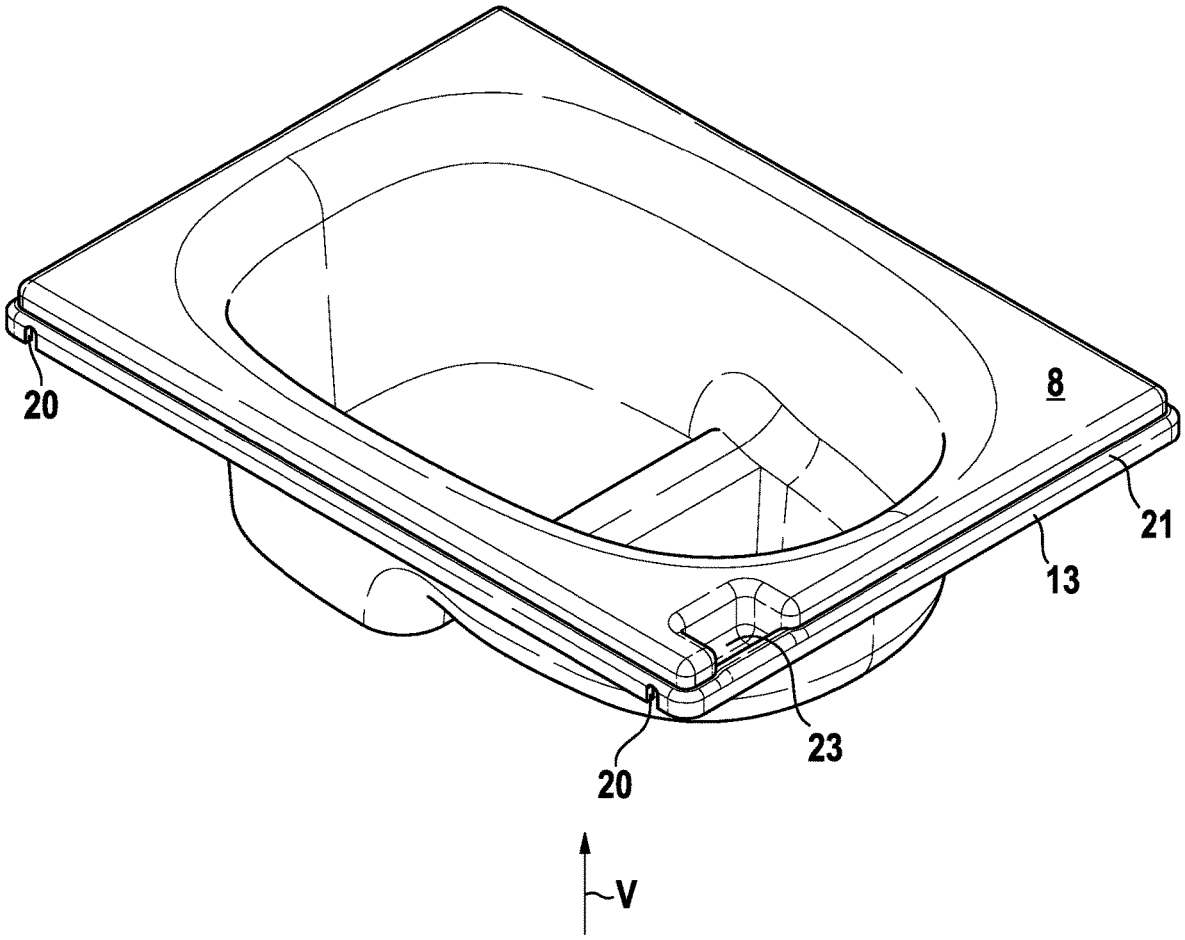
FIG. 3: shows a perspective view of a separating insert of the separating toilet according to the invention.

FIG. 3 shows an isometric view of the separating insert obliquely from above. The recesses 20 that open downward in the vertical direction V are visible. The peripheral edges 13 are embodied as stepped in the vertical direction V so as to form a preferably circumferential shoulder 21. As a result, an insertion gap 22 is formed that has a larger gap width in comparison to the gap 16 and in particular, is oriented and embodied in such a way that ribs, which optionally protrude downward from a cover (not shown) or from another stacking container (not shown) that can be stacked on the transport container 2, can be inserted into the insertion gap 22. The shoulder 21 and the lower part of the peripheral edges 13 in the vertical direction V thus close the insertion gap 22 toward the bottom or taper to a gap width of the gap 16.

The circumferential peripheral edge 13 that points downward in the above-described way significantly increases the rigidity of the seat 8 against flexing. In particular, in addition to forming an insertion gap 22, providing the shoulder 21 also achieves a further mechanical stiffening of the separating insert 7 against flexing.

A recessed grip 23 is advantageously formed in the vicinity of the seat 8 in the edge region of the separating insert 7.

Figure 4:
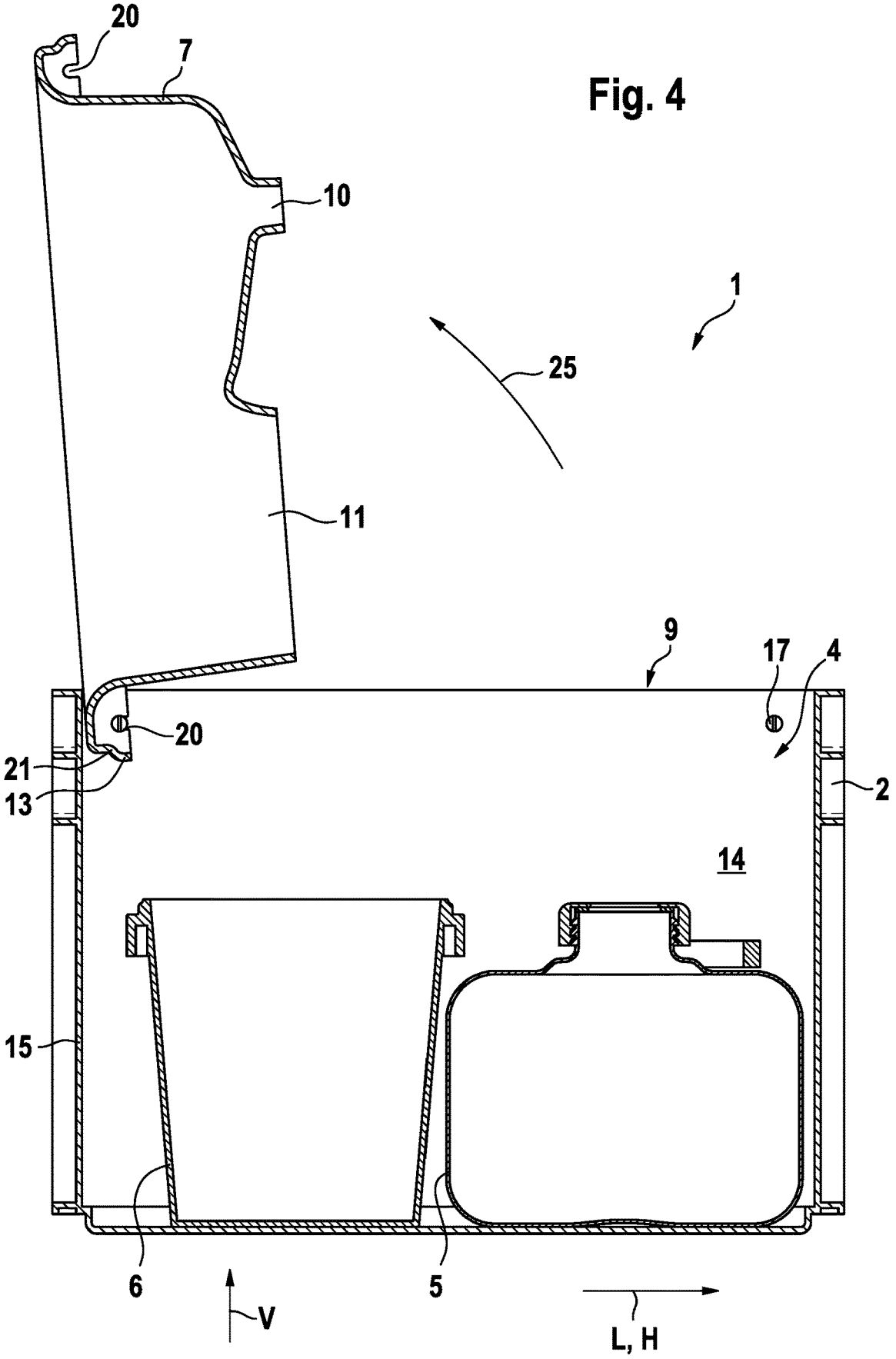
FIG. 4: shows the longitudinal section from FIG. 2, with the separating insert opened in a hinged fashion.

The separating insert 7 is also preferably supported in hinged fashion around at least two of the projections 17 so that the separating insert 7 can be easily pivoted out of the horizontal position into an open position (see FIG. 4), for example by means of the recessed grip 23. This pivotability is indicated by the arrow 25.

In a particularly advantageous embodiment, the transport container 2 is embodied as a standardized stacking container, for example as a euronorm container. Through this embodiment, the separating toilet 1 according to the invention can be integrated in a particularly space-saving way for example into a tower composed of multiple stackable containers (euronorm containers) and does not require a separate storage space, for example in a cramped environment such as a camping vehicle.

The separating toilet according to the invention can thus also be inserted in a particularly easy, space-saving way into any position in a stackable tower consisting of stacking boxes that correspond to one another and can thus be stored and transported therein.

It can also be particularly advantageous, for example in order to easily adjust a desired seat height for the user of the separating toilet 1, to place or provide one or more other corresponding stacking containers under the transport container 2 that contains the elements of the separating toilet, for example in order to achieve a comfortable seat height.

The separating toilet according to the invention thus achieves, particularly using inexpensive and readily available standardized stacking containers, a particularly space-saving separating toilet that can be easily produced with a small number of parts, which can be set up and transported in a particularly variable way and can be produced at a low cost from a small number of parts.

The invention claimed is:

1. A separating toilet comprising:

a separating insert and at least one first collecting unit for urine and a second collecting unit for feces, wherein the separating insert as a whole is inserted into an opening of a transport container and is supported in a vertical direction on projections that protrude from an inner side of the transport container toward an interior of the transport container, and wherein a circumferential peripheral edge of the separating insert is embodied as at least partially stepped in cross-section so that between the separating insert and an upper region of the inner side a circumferential insertion gap is formed when the separating insert is inserted into the transport container.

2. The separating toilet according to claim 1, wherein a circumferential peripheral edge of the separating insert has recesses with which the separating insert can be placed onto the projections.

3. The separating toilet according to claim 1, wherein a seat of the separating insert ends flush with an upper edge of the transport container.

4. The separating toilet according to claim 1, wherein the transport container is a wood, metal, or plastic container.

5. The separating toilet according to claim 1, wherein the projections are each formed by a respective cap nut, which is screwed onto a screw that reaches through a side wall of the transport container.

6. The separating toilet according to claim 1, wherein the first collecting unit, the second collecting unit, and the separating insert can be accommodated in the transport container.

7. The separating toilet according to claim 1, wherein viewed from above, an outer contour of the separating insert is adapted to an inner contour of the transport container and can be inserted into the opening of the transport container without play or almost without play, forming a small gap.

8. The separating toilet according to claim 1, wherein the insertion gap is oriented and embodied in such a way that rib regions can be guided into the insertion gap.

9. The separating toilet according to claim 8, wherein the rib regions are circumferential ribs of a cover.

10. The separating toilet according to claim 1, wherein the separating insert is supported in hinged fashion around at least two projections.

11. The separating toilet according to claim 10, wherein the separating insert is supported in pivoting fashion relative to the transport container.

12. The separating toilet according to claim 1, wherein the separating insert has a recessed grip.

13. The separating toilet according to claim 12, wherein the recessed grip is positioned at an edge of the separating insert.

14. The separating toilet according to claim 1, wherein the transport container is a stackable container.

15. The separating toilet according to claim 14, wherein the transport container is a euronorm container.

16. The separating toilet according to claim 1, wherein the separating insert is deep drawn from a thermosetting plastic material.

17. The separating toilet according to claim 16, wherein the separating insert is deep drawn from an ABS plastic plate material.

* * * * *